US006505994B1

(12) United States Patent
Attar

(10) Patent No.: US 6,505,994 B1
(45) Date of Patent: Jan. 14, 2003

(54) ONE PIECE REFLECTIVE DELINEATOR AND METHOD OF MAKING

(76) Inventor: Adil Attar, P.O. Box 3883, Claremont, CA (US) 91761

( * ) Notice: Subject to any disclaimer, the term of this patent is extended or adjusted under 35 U.S.C. 154(b) by 0 days.

(21) Appl. No.: 09/650,031

(22) Filed: Aug. 28, 2000

(51) Int. Cl.[7] ..... E01F 9/00
(52) U.S. Cl. ..... 404/16; 404/9; 404/72
(58) Field of Search ..... 404/9, 10, 12, 404/13, 16; D10/113; 359/531, 532

(56) References Cited

U.S. PATENT DOCUMENTS

| | | | | | |
|---|---|---|---|---|---|
| 3,179,009 | A | * | 4/1965 | Sheffield et al. | 404/16 |
| 3,712,706 | A | * | 1/1973 | Stamm | 350/103 |
| D236,818 | S | * | 9/1975 | Stenemann | D10/111 |
| 3,922,065 | A | * | 11/1975 | Schultz | 350/103 |
| 4,035,059 | A | * | 7/1977 | DeMaster | 350/105 |
| 4,123,181 | A | * | 10/1978 | Schueler et al. | 404/9 |
| 4,221,498 | A | * | 9/1980 | Schueler et al. | 404/9 |
| D260,742 | S | * | 9/1981 | Mihailoff | D10/109 |
| 4,445,803 | A | * | 5/1984 | Dixon | 404/10 |
| 4,521,129 | A | * | 6/1985 | Krech et al. | 404/10 |
| 4,534,673 | A | * | 8/1985 | May | 404/14 |
| 4,588,258 | A | * | 5/1986 | Hoopman | 350/103 |
| 4,991,994 | A | * | 2/1991 | Edouart | 404/10 |
| D354,246 | S | * | 1/1995 | Weid | D10/113 |
| 5,460,115 | A | * | 10/1995 | Speer et al. | 116/63 P |
| D377,623 | S | * | 1/1997 | Weid | D10/113 |

* cited by examiner

*Primary Examiner*—Gary S. Hartmann

(57) ABSTRACT

Disclosed a method of integrally forming a temporary roadway delineator, a chip seal marker or barrier delineator. This method includes integrally forming multiple cube comer reflective elements on at least one side or both sides of the vertically extending reflective face portion of a delineator. Protective raised barrier walls can also be integrally provided on both sides of the vertically extended reflective face portion. The monolithically formed delineator, in accordance to this invention, can be fabricated in either one or two stage injection molding process, thereby integrally providing either one or two structural or color zones. Pressure sensitive adhesive can be applied to the base surface of a delineator or temporary marker for direct application to a roadway or to a barrier surface.

1 Claim, 2 Drawing Sheets

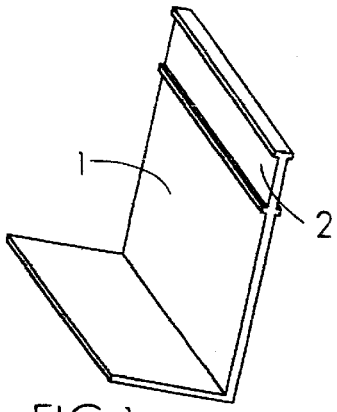
FIG. 1 (Prior Art)
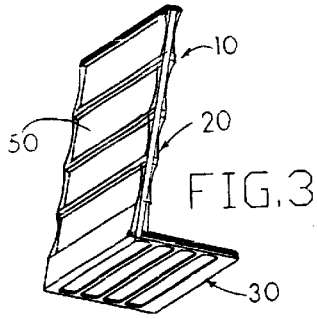
FIG. 3
FIG. 6
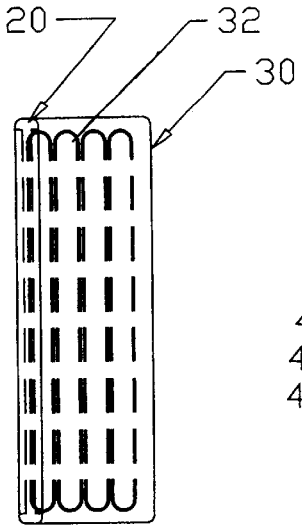
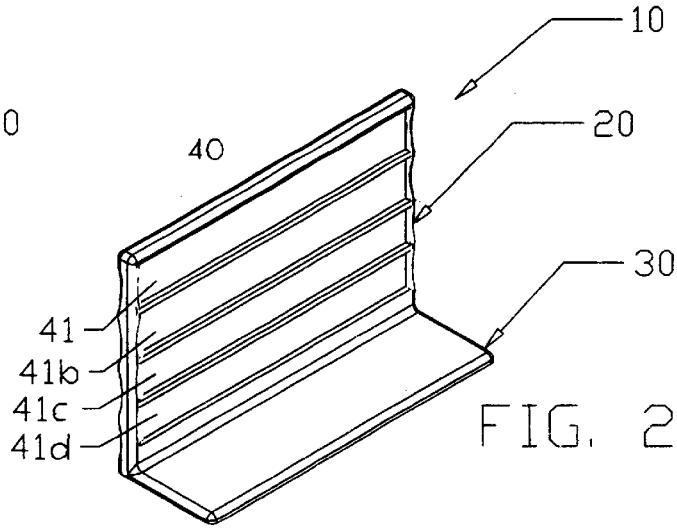
FIG. 2
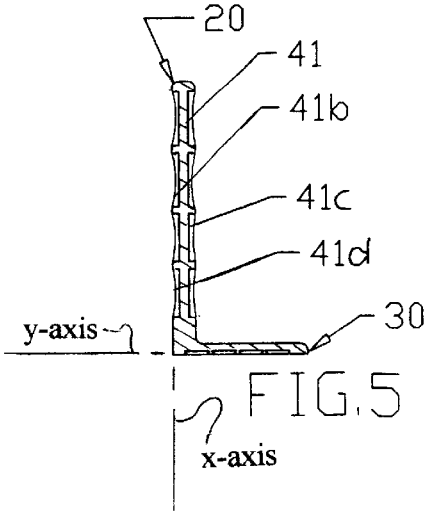
FIG. 5
FIG. 4
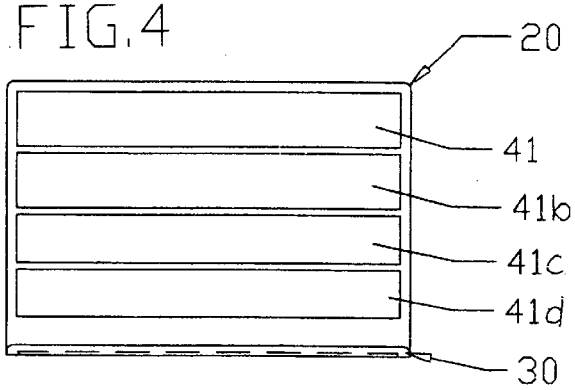

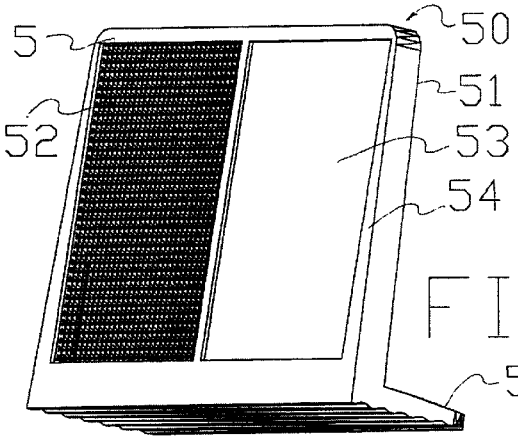
FIG.7
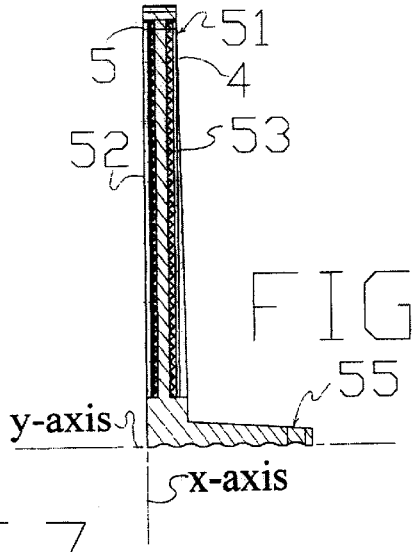
FIG.9
FIG.8
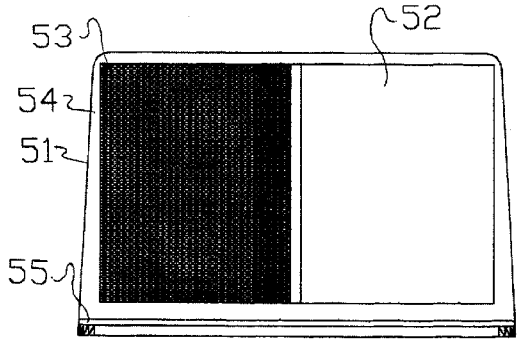
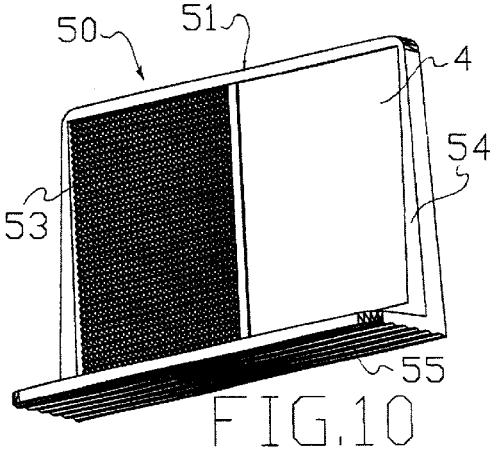
FIG.10

ONE PIECE REFLECTIVE DELINEATOR AND METHOD OF MAKING

BACKGROUND OF THE INVENTION

This invention relates to retro-reflective roadway delineator normally used for median barriers as well as special variations of said delineator are used either as a temporary roadway marker or slurry seal marker. Various phases of highway constructions require specific types of delineator or temporary marker. The frequently applied delineator is used during the first few weeks after top coating of an asphalt concrete pavement.

This invention has greatly improved structural and optical features as well as considerably reducing cost of manufacturing such highway safety devices, by inventing a novel process for making such delineators for use over a wide range of roadway applications and needs.

The use of protective concrete barriers or u-shaped guardrails is a standard fixture in modem highways, such as freeways, bridges and surface roadways.

This type of barriers is used protectively to separate two-way traffics, especially when there are not enough protective medians spacing available. The prevailing trend is the use of concrete barriers for their effectiveness, flexibility, minimum maintenances and esthetic values.

In order to enhance the safety of motorist during severe weather conditions or during nighttime driving conditions, retro-reflective markers are affixed onto the upper portions of such barrier structures.

Prior arts for barrier reflective delineator marking has been generally made in processes that have two or three elements or steps. The most commonly used geometric shape for roadway construction delineator is an L or T shaped delineator. This type of delineators are made of at least two parts, the L or T shaped resilient body, plus at least one retro reflective strip agglutinated on the vertical side of said resilient body.

A layer of a thixotropic and moisture sensitive adhesive is fixed to the base of said delineator for direct application to the roadway or to a barrier. These types of delineators require several steps for assembling of said delineator, most notably, the separate forming of the reflective sheeting or purchasing said sheeting from independent vendors.

Other prior art temporary markers that require longer lifetime use, specially during construction phases with duration of about six months to a year period are generally made of hollowed structural plastic body, such as ABS, polyurethane or other plastic with reflective sheeting welded onto said body.

All previous arts need the additional steps of separately forming the retro reflective strips and the step of agglutination of at least one reflective strip onto the vertical sides of the resilient body for delineation.

Such reflective sheeting has different structural and thermal properties from that of the L shaped resilient body of the prior arts.

These differences tend to create stress failures and eventual break up, thereby detachment of the reflective sheeting from the delineator body.

Exemplary of other temporary roadway markers or delineators previously known are such as disclosed in U.S. Pat. No. 4,224,002 issued to S. A. Heenan, U.S. Pat. No. 4,534,673 issued to May, U.S. Pat. No. 4,991,994 issued to Edouart and U.S. Pat. No. 5,460,115 issued to Speer.

SUMMARY OF THE INVENTION

The primary objective of this invention is to provide a simple, durable, inexpensive and effective process of manufacturing delineators and temporary roadway markers with very high retro-reflective capability, which can be formed in a single step process thereby forming the reflective faces as well as the body of said temporary marker or delineator from one or two types of durable, resilient and tear resistant polymer.

In accordance to other aspects of this invention, is to provide a durable and highly effective barrier marker or delineator marker in a single step process having any desired body shape monolithically including the retro-reflective faces.

Anther feature of the present invention is the textured and grooved base surface of said delineator, which allow said marker to be mounted either on a roadway or on a vertical faces of a barrier.

It is further objective of the present invention is the use of raised ridges on both sides of the vertically positioned reflective face portion of the delineator to provide protection from direct tire contact, especially where such delineator is used during the drying period of the slurry seal coat application and to enhance the structural support and tear resistance of said delineator face.

Another feature of the present invention is to provide a temporary reflective delineator that can be used effectively for a short to medium period delineation. Anther aspect of the present invention, is to provide a temporary roadway delineator that include textured planar base surfaces to affix pressure sensitive adhesive for agglutination of said marker to roadways or barriers.

BRIEF DESCRIPTION OF THE DRAWINGS

FIG. 1 (FIG. Prior Art-1) is an isometric view of conventional slurry seal delineator.

FIG. 2 is an isometric view of preferred delineator made in accordance to the invention.

FIG. 3 is another isometric view of the delineator of FIG. 2 showing the back side.

FIG. 4 is an elevation view of the delineator of FIG. 2.

FIG. 5 is a cross sectional view taking along line 5—5 in FIG. 4.

FIG. 6 is a plan view of the delineator of FIG. 2 showing the base with textured grooves.

FIG. 7 is an isometric view of another preferred multi purpose delineator.

FIG. 8 is an elevation view of the delineator of FIG. 7.

FIG. 9 is a cross sectional view taking along line 9—9 in FIG. 7.

FIG. 10 is a plan view of delineator of FIG. 7 showing the base with textured grooves.

DETAILED DISCRIPTION

FIG. 1 (Prior Art 1) illustrates a schematic view of a typical L shaped delineator. This delineator is made either by extrusion or injection molding of body 1, and the additional steps of agglutinating one or two reflective strips 2 to the vertical sides of body 1. Each strip 2 is having multiple of cube comer reflective elements.

The present invention is a novel process for forming the entire delineator or temporary roadway marker's structural body as well as the cube corner reflective elements in one single injection molding process, said delineator or temporary roadway marker made of one kind or two kinds of high impact and tear resistant thermoplastics. At least the reflective face portion integrally made of optically clear polymeric plastic, integrally including the cube corner reflective elements on designated cell like areas within the delineator's vertical sides.

The illustrated embodiments in FIGS. 2 through 10 exemplify delineators that can be manufactured according to the process of the present invention.

FIGS. 2 and 3 show one of the preferred embodiments of a delineator 10. Delineator 10 is manufactured using means in accordance to the present invention. Delineator 10 integrally comprises a planar base portion 30 and near vertically extended reflective face portion 20, integrally with two distinct sides, a front side 40 and a back side 50.

FIG. 3 shows the nearly vertical front side 40 of the reflective face portion 20 integrally divided into four-recessed planar cell like areas 41,41*b*, 41*c*, and 41*d*.

Also shown is the planar base portion 30 with the textured discontinuous grooves. Base portion 30 can have slightly tapered top surface.

This invention provide means to integrally form multiple of retro- reflective cube corner elements on at least one recessed cell like area 41 within the back side 50, thereby retaining the transparent planar surface of the cell like area 41 on the front side 40 for intercepting light from oncoming traffic.

An alternative mean would be to integrally form the retro reflective cube corner elements on two recessed cell like areas 41 and 41*c* within the back side 50, whereby retaining the transparent planar surfaces of both cell like areas 41 and 41*c* on the front side 40 for intercepting light from oncoming traffics.

Likewise, this invention provides the means to form multi-directional reflective delineator. This is achieved by integrally forming retro reflective cube corner elements on at least one of the remaining recessed cell like areas 41*b* and 41*d*, on their opposite sides, that is on the front side 40 of the near vertical reflective face 20, thereby retaining the transparent planar surfaces of both cell like areas 41*b* and 41*d* on the back side 50 for intercepting light from the opposite direction, thereby having a multi-directional retro reflective delineator 10 monolithically formed in one single step injection molding process.

Both sides, front side 40 and the backside 50 of the reflective face portion 20 have barrier walls 42 and 42*b*, defining each recessed reflective cells 41. The barrier walls 42*b* are defining the vertical periphery of each side of the reflective face portion 20, and will be formed having variable curved surface, for added stiffness and resiliency. The reflective face 20 is formed having tapered thickness. The starting thickness near the base will be slightly larger than top portion of said reflective face 20.

Delineator 10 can be made of various polymeric materials with good optical, resilient and tear resistant properties. The injection molding process of forming delineator 10 can be of one stage molding or a two stage molding, whereby either two colors or two different structural zones are formed integrally within the delineator 10 body.

The integrally formed cube corner reflective elements within both sides of the reflective face 20 can be further protected, by providing raised beaded periphery, immediately adjacent to the monolithically formed cube comer reflective elements within the recessed cell like areas. A thin sheet made of compatible polymer is then welded onto said periphery beaded border, without allowing said thin sheet to touch the vertexes of the cube corner reflective elements. This process also eliminate an additional step of metal coating of the previously used reflective strips, as in the prior art shown in FIG. 1. Another commonly practiced temporary reflective lens protection for this type of delineator is to provide a transparent and flexible thin jacket, secured by stapling said jacket onto the vertical portion 20.

This type of thin transparent jacket can also be used in this invention for added protection.

FIG. 7 through FIG. 10 show another preferred delineator 50 that can be monolithically formed in accordance to the process of this invention.

Delineator 50 has an alternative geometric shape, comprising of a base portion 55 and a near vertically extending face portion 51. The face portion 51 can be integrally formed either with one recessed cell like area or two-recessed cell like areas. Face portion 51 can be slightly tapered, thereby having a lower segment near the base portion 55 slightly thicker than the top extended portion.

FIG. 7 shows delineator 50 with an extended face portion 51 having a front side 4 and backside 5. Both sides 4 and 5 are integrally formed having two-recessed cell like areas 52 and 53 and barrier walls 54 defining each of the cells 52 and 53. This invention is providing the means to monolithically form retro reflective cube corner elements inside the cell like area 52, at the backside 5, and simultaneously forming retro reflective cube corner elements inside the cell like area 53, at the front side 5, thereby creating a multi directional delineator in one single step injection molding process.

An added protection of the cube comer reflective elements can be achieved, by sealing this cell like areas with corresponding thin sheets, such as 58 and 58*b*, provided that such protective coverings would not touch the apexes of the cube corner elements. Delineator 50 can be ideally used either as a barrier delineator, agglutinated to the top or the sides of barrier walls, or it can effectively be used as roadway delineator. Various types of cube corner reflective elements and method of forming the same are available and can be incorporated in the process of forming delineators or temporary roadway markers in accordance to the present invention.

Descriptions of suitable cube corner reflective elements are provided in U.S. Pat. No. 3,712,706 to Stamm; U.S. Pat. No. 3,922,065 to Schultz; and U.S. Pat. No. 4,588,258 to hoopman, all of which are incorporated herein by reference in their entireties.

Delineator 10 or 50 can be formed having at least the reflective face portion 20 made from a highly resilient structural polymer. The joining area between the inside surface 40 and the top part of the base portion 30 will have slightly curved transition for added resiliency, and can be formed, integrally either having the same structural properties or from a polymer with different flexural modulus.

It is understood that various changes or modifications can be made within the scope of this invention and its claims to the above-preferred process of forming single piece reflective delineator without departing from the scope and spirit of the invention. The principle processes of this invention are not limited to the particular embodiments described herein. Various embodiments can employ the processes of this invention. This invention is not limited to the exact method illustrated and described; alternative methods can be used to form the intended monolithically formed single piece reflective delineator of this invention. Therefore, the invention can be practiced otherwise than as specifically described herein.

What is claimed:

1. A method for forming a reflective delineator monolithically including a plurality of cube comer reflective elements comprising the steps of:

a) providing molding means that allow injection molding a reflective delineator having a textured planar base portion and an integrally extended, near vertical reflective face portion, said near vertical face portion being adopted to integrally facilitate a plurality of cube comer reflective elements protruding within at least one designated cell-like area on both sides of said near vertical reflective face portion, each of said cell like area has a opposing planar transparent surface facing oncoming traffics, thereby providing retro-reflection based on automobile light beams, said molding means comprising upper and lower mold portions incorporating the cavity and core positioned there between and at least one runner for injection molding polymeric plastic material into said molding means, said molding means can mold said reflective delineator in one or two-stage injection molding cycle, said molding means can form said delineator from a unitary, transparent polymeric material or from two compatible polymeric plastic materials having slightly differing structural properties;

b) providing an angular position for said molding means to set the cavity and core elements positioned to have an open-close axis (y-axis) within said upper and lower mold portions near parallel to said planar base portion of said delineator being formed, said molding means to have an x-axis near parallel to the planar reflective face portion of said reflective delineator being formed, thereby providing uninterrupted ejection cycle for said integrally formed plurality of cube comer reflective elements within said planar reflective face portion during injection molding of said reflective delineator, c) monolithically forming said reflective delineator including said plurality of cube corner reflective elements on both sides of said reflective face portion.

* * * * *